US008686933B2

(12) United States Patent
Kim et al.

(10) Patent No.: US 8,686,933 B2
(45) Date of Patent: Apr. 1, 2014

(54) LIQUID CRYSTAL DISPLAY DEVICE FOR IMPROVING PICTURE QUALITY AND DRIVING METHOD THEREOF

(75) Inventors: Ki Duk Kim, Gunpo-si (KR); Bo Gun Seo, Paju-si (KR); Sun Young Kim, Hwaseong-si (KR)

(73) Assignee: LG Display Co., Ltd., Seoul (KR)

( * ) Notice: Subject to any disclaimer, the term of this patent is extended or adjusted under 35 U.S.C. 154(b) by 569 days.

(21) Appl. No.: 12/289,913

(22) Filed: Nov. 6, 2008

(65) Prior Publication Data

US 2009/0289961 A1 Nov. 26, 2009

(30) Foreign Application Priority Data

May 20, 2008 (KR) ..... 10-2008-0046818

(51) Int. Cl.
*G09G 3/36* (2006.01)

(52) U.S. Cl.
USPC ..... 345/89

(58) Field of Classification Search
USPC ..... 345/89, 102
See application file for complete search history.

(56) References Cited

U.S. PATENT DOCUMENTS

| | | | | |
|---|---|---|---|---|
| 7,760,174 | B2 * | 7/2010 | Ku | 345/89 |
| 2002/0030652 | A1 * | 3/2002 | Shibata et al. | 345/87 |
| 2004/0012551 | A1 * | 1/2004 | Ishii | 345/102 |
| 2004/0113906 | A1 | 6/2004 | Lew et al. | |
| 2004/0140985 | A1 * | 7/2004 | Liaw | 345/690 |
| 2006/0017713 | A1 * | 1/2006 | Lee et al. | 345/204 |
| 2006/0103621 | A1 * | 5/2006 | Feng | 345/102 |
| 2006/0284897 | A1 * | 12/2006 | Shen et al. | 345/690 |
| 2006/0290642 | A1 * | 12/2006 | Kim et al. | 345/98 |
| 2007/0216636 | A1 * | 9/2007 | Lo | 345/102 |

FOREIGN PATENT DOCUMENTS

| | | |
|---|---|---|
| CN | 1979272 | 6/2007 |
| KR | 10-2006-0027220 A | 3/2006 |
| KR | 10-2007-0026053 A | 3/2007 |
| TW | 200414114 | 8/2004 |

* cited by examiner

*Primary Examiner* — Adam J Snyder
(74) *Attorney, Agent, or Firm* — McKenna, Long & Aldridge, LLP

(57) ABSTRACT

An LCD device adapted to improve its picture quality in spite of the brightness variation includes: a gray scale modulator modulating R, G, and B data; a backlight dimming controller generating a back dimming signal that is inversely proportional to the modulated R, G, and B data generated in the gray scale modulator; and an over driving controller selectively overshoot-compensating the R, G, and B data from the gray scale modulator in every gray scale level through the comparison of the R, G, and B data of current frame and the R, G, and B data of previous frame, wherein, the modulated R, G, and B data each include maximum gray scale levels lower than those of the overshoot compensated R, G, and B data.

9 Claims, 2 Drawing Sheets

LIQUID CRYSTAL DISPLAY DEVICE FOR IMPROVING PICTURE QUALITY AND DRIVING METHOD THEREOF

This application claims the benefit of Korean Patent Application No. 10-2008-0046818, filed on May 20, 2008, which is hereby incorporated by reference for all purposes as if fully set forth herein.

BACKGROUND

1. Field of the Disclosure

The present invention relates to a liquid crystal display device which is capable of preventing a brightness deterioration in spite of dimming of the backlight unit below 100 percent.

2. Description of the Related Art

As the information society spreads, the requirements for display devices are varied and gradually increasing. In accordance therewith, a variety of display devices such as liquid crystal display (LCD) devices, plasma display panels (PDP), electro-luminescent display (ELD) devices, vacuum fluorescent display (VFD) devices, and so on, have been researched. Furthermore, some display devices already have been applied to many appliances.

More specifically, the LCD devices are rapidly replacing cathode ray tubes (CRTs) and are used most often as a portable image (or picture) display device, because they have features such as superior picture quality, light weight, slimness, low power consumption, and so on. These LCD devices are being developed in a variety of shapes which are applied to computer monitors, television display screens, and so on, as well as to portable notebook computer monitors.

The LCD devices use anisotropic and polarizing characteristics of liquid crystal in order to display an image. It is possible to directionally align liquid crystal molecules because they are thin and long. In accordance therewith, the alignment direction of the liquid crystal molecules can be controlled by an electric filed applied to the liquid crystal.

The LCD devices of the related art can be generally defined into an LCD panel displaying an image (or a picture) and a drive portion applying drive signals to the LCD panel.

The LCD panel includes two substrates combined to form a fixed cell gap and a liquid crystal layer interposed between the two substrates. Any one of these substrates includes gate lines arranged to separate from each other by a fixed distance, data lines perpendicularly arranged to the gate lines and defining pixel regions, and thin film transistors (TFTs) formed in intersecting portions of the gate lines and the data lines. Each of the thin film transistors responds to a scan signal from the gate line and transfer a data signal from the data line to a pixel electrode. Accordingly, the pixel electrodes on the pixel regions sequentially receive the data signals line by line, as the scan signal is sequentially applied to the gate lines, thereby displaying an image (or a picture).

Such LCD devices are mostly driven in a dimming system that applies the data signal to each pixel and simultaneously turns on and off a backlight unit. More specifically, the backlight unit maintains a turning off state before the thin film transistor of any one pixel is turned on, and goes to a turning-on state when the data signal is charged in the one (or the pixel), thereby the LCD device displays one image (or one picture). As a result, the LCD device can prevent a blurring phenomenon.

However, the LCD device with the backlight unit of dimming system has a problem in that the brightness is deteriorated from repeatedly turning on and off its light sources.

BRIEF SUMMARY

Accordingly, the present invention is directed to a liquid crystal display device and driving method thereof that substantially obviates one or more of the problems due to limitations and disadvantages of the related art.

An advantage of the present embodiment is to provide an LCD device that is adaptive to compensate for the brightness deterioration caused by dimming of a backlight unit, and driving method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an LCD device includes: a timing controller generating control signals for an image display; a gray scale modulator modulating R, G, and B data from the timing controller; a backlight dimming controller generating a back dimming signal which is inversely proportional to the modulated R, G, and B data generated in the gray scale modulator; and an over driving controller selectively overshoot-compensating the R, G, and B data from the gray scale modulator in every gray scale level through the comparison of the R, G, and B data of current frame and the R, G, and B data of previous frame. Wherein, the modulated R, G, and B data each include maximum gray scale levels lower than those of the overshoot compensated R, G, and B data.

In another aspect of the present invention, an LCD device includes: modulating R, G, and B data from the exterior in the gray scale; and selectively overshoot-compensating the R, G, and B data from the gray scale modulator in every gray scale level through the comparison of the R, G, and B data of current frame and the R, G, and B data of previous frame. Herein, the modulated R, G, and B data have maximum gray scale levels lower than those of the overshoot-compensated R, G, and B data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION

Figure 1:
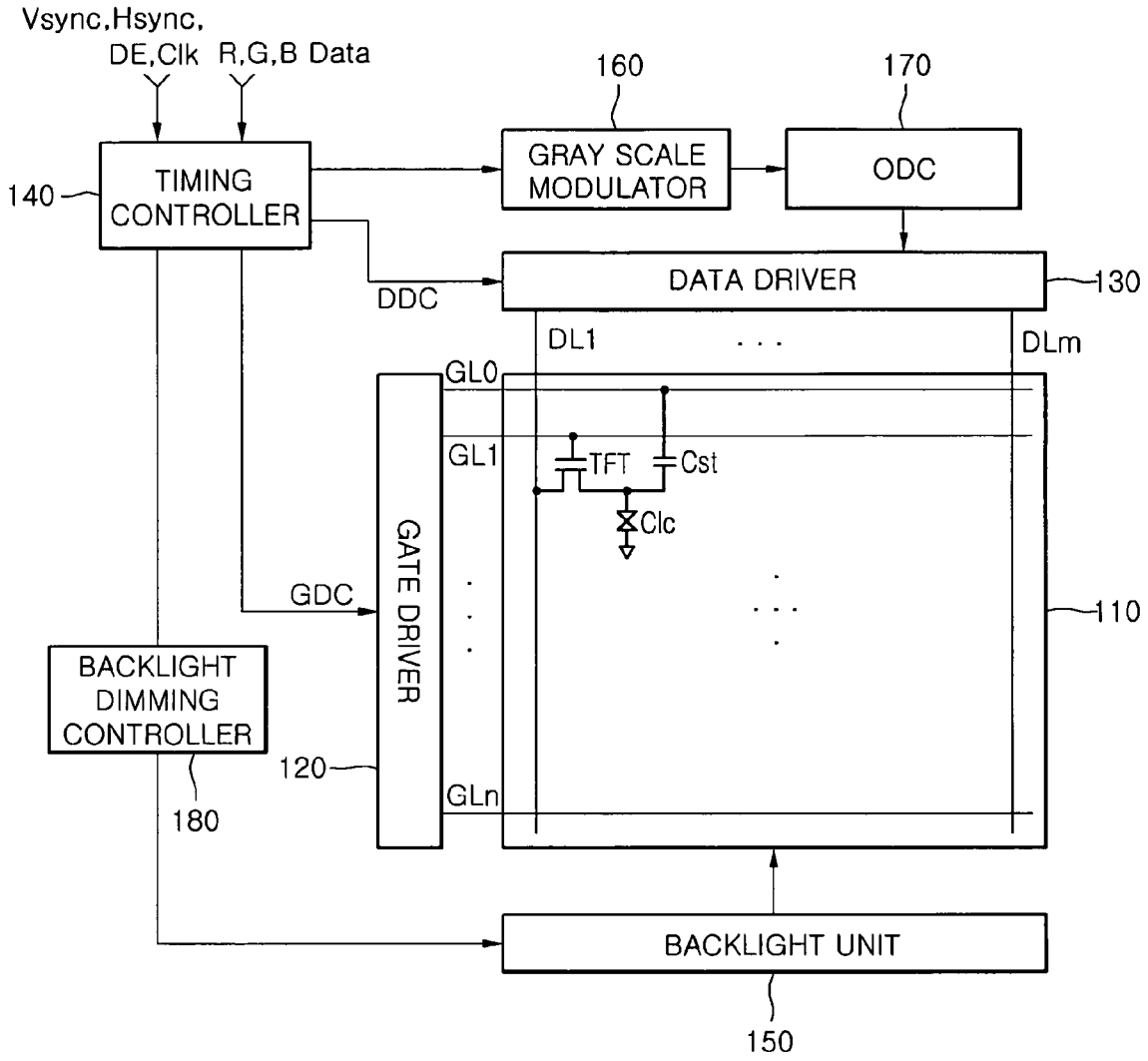
FIG. 1 is a configuration diagram showing an LCD device according to an embodiment of the present disclosure.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

Figure 2:
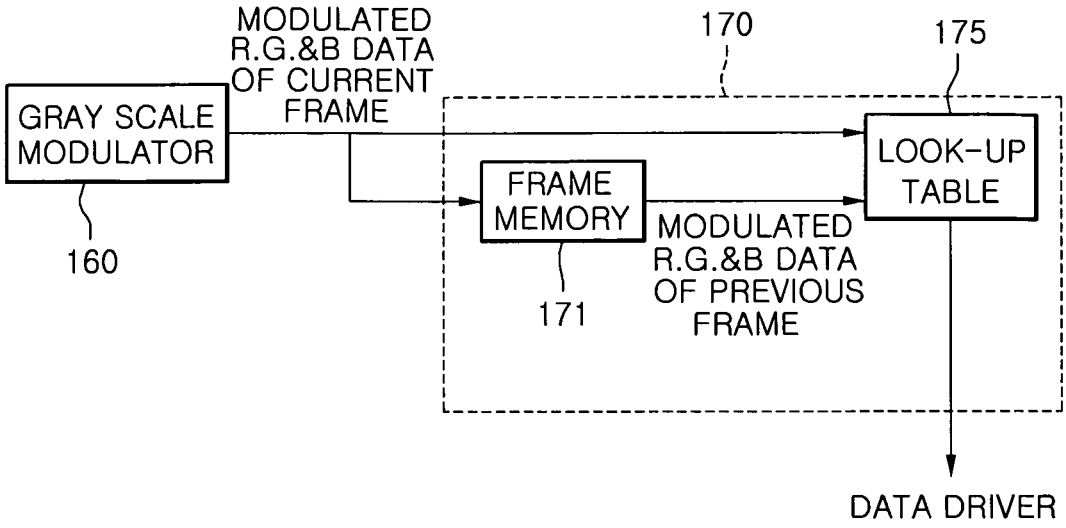
FIG. 2 is a detailed view showing a gray scale modulator and an ODC in FIG. 1.

FIG. 1 is a configuration view showing an LCD device according to an embodiment of the present disclosure. FIG. 2 is a detailed view showing an gray scale modulator and an over-driving controller (ODC) in FIG. 1. Referring to FIGS. 1 and 2, an LCD device, according to an embodiment of the present disclosure, includes an LCD panel 110 having liquid crystal cells arranged in a matrix shape, a gate driver 120 driving gate lines GL1 to GLn on the LCD panel 110, a data driver 130 driving data lines DL1 to DLm on the LCD panel, and a timing controller 140 controlling the gate and data drivers 120 and 130. The LCD device according to the embodiment of the present disclosure further includes a gray scale modulator 160 modulating red (R), green (G), and blue (B) data of previous and current frames from the timing controller 140, a backlight dimming controller 180 providing a backlight dimming signal which is inversely proportional to the modulated R, G, and B data generated in the gray scale modulator 160, an over-driving controller 170 comparing the modulated R, G, and B data of the current frame from the gray scale modulator 160 and the modulated R, G, and B data of the previous frame and selectively applying the overshoot-compensated R, G, and B data and the modulated R, G, and B data of the current frame to the data driver 130, and a backlight unit 150 applying lights to the LCD panel 110.

The LCD panel 110 includes thin film transistors TFT that are formed in the portions in which the gate lines GL1 to GLn and the data lines DL1 to DLm cross each other, as a switch element. The thin film transistors TFT are turned on and apply the data signals from the respective data lines DL1 to DLm to their respective liquid crystal cells, when the scan signal of a gate high voltage VGH is applied from the respective gate lines GL1 to GLn. Alternatively, when the scan signals of a gate low voltage VGL are applied from the corresponding gate line GL1 to GLn, the thin film transistors are turned off so that the liquid crystal cells maintain a charged data voltage.

The liquid crystal cell is equivalently indicated to a liquid crystal capacitor Clc. Also, the liquid crystal cell Clc includes a common electrode and a pixel electrode facing each other in the center of the liquid crystal. The pixel electrode is connected to the thin film transistor TFT. This liquid crystal cell Clc varies the alignment state of liquid crystal molecules having a dielectric anisotropy in accordance with the pixel data voltage (or the voltage of the data signal, or the pixel voltage) which is charged in it through the thin film transistor TFT, and controls its light transmittance, thereby implementing the gray scale.

In order to maintain the data signal (or pixel signal) charged in the liquid crystal cell Clc until it is applied again, a storage capacitor Cst is provided. The storage capacitor Cst is formed between the pixel electrode and the previous gate line.

The timing controller 140 receives a data enable signal DE, a clock signal Clk, and vertical/horizontal synchronous signals Vsync/Hsync which are applied from an external system not shown in the drawings. The timing controller 140 derives gate control signals GDC and data control signals DDC, for controlling the gate and data drivers 120 and 130 from the received signals.

The data driver 130 responds to the data control signals DDC from the timing controller 140 and applies the data signals line by line to the data lines DL1 to DLm every horizontal period. More specifically, the data driver 130 uses gamma voltages from a gamma voltage generator (not shown) and converts digital pixel data from the timing controller 140 into the pixel data signal of an analog shape. The converted pixel data signal is applied to the data line DL1 to DLm.

The gate driver 120 depends on the gate control signals GDC generated in the timing controller 140, and sequentially applies the gate high voltage VGH and the gate low voltage VGL to the gate lines GL1 to GLn.

The backlight unit 150 depends on the dimming signal from the backlight dimming controller 180 and is driven in a dimming system. The backlight dimming controller 180 determines a duty cycle of the dimming signal, that is, a dimming duty cycle of light sources (i.e., lamps or light emission diodes) included in the backlight unit 150. Herein, if the dimming duty cycle decreases, the brightness in the LCD panel 110 reduces by the decreased amount of the dimming duty cycle.

In order to compensate for such brightness deterioration, the gray scale modulator 160 modulates the R, G, and B data applied from the timing controller 140 in the gray scale, by the decrement amount of the duty cycle of the dimming signal. The gray scale modulator 160 applies the gray-scaled R, G, and B data to the ODC 170.

In this way, the gray scale modulator 160 modulates the received R, G, and B data in the gray scale value. Herein, the modulated R, G, and B data are ranked within a range of gray scale levels smaller than the one of R, G, and B data over-driven by the ODC 170, but larger than the data received from the timing controller 140. For example, if the modulated R, G, and B data has the range of "0" to "244" gray scale levels, the received data from the timing controller 140 may be in the range of "0" to "100" and the over-driven data also may become in the range of "0" to "255" gray scale levels. Accordingly, the gray scale modulator 160 can compensate for the brightness variation due to the dimming operation of the backlight unit 150, in the state of over driving the LCD panel 110. As a result, the gray scale modulator 160 may prevent the deterioration of picture quality.

The ODC 170 is not driven when the R, G, and B data of the current frame applied from the gray scale modulator is the same as those of the previous frame, for example, in case of R, G, and B data of a still picture. In other words, the ODC 170 originally outputs the modulated R, G, and B data of the still picture to the data driver 130. Alternatively, the ODC 170 is driven when the R, G, and B data of the current frame applied from the gray scale modulator is different from those of the previous frame, that is, in case of R, G, and B data of a moving picture. In this case, the ODC 170 derives the overshoot compensated R, G, and B data from the modulated R, G, and B data and applies the overshoot compensated R, G, and B data to the data driver 130.

To this end, the ODC 170 includes: a frame memory 171 delaying the modulated R, G, and B data from the gray scale modulator 160 during one frame period; and a look-up table 175 comparing the delayed R, G, and B data (i.e., the modulated R, G, and B data of the previous frame) from the frame memory 171 with the modulated data (i.e., the modulated R, G, and B data of the current frame) from the gray scale modulator 160, and selectively outputting the overshoot compensated R, G, and B data and the modulated R, G, and B data of the current frame in accordance with the comparing resultant, as shown in FIG. 2.

The look-up table 175 uses the modulated R, G, and B data of the current frame and the modulated R, G, and B data of the previous frame as an x-axis address and an y-axis address, respectively. Also, the look-up table 175 stores the overshoot compensated R, G, and B data and the modulated R, G, and B data which are arranged in accordance with the x-axis and y-axis addresses. Accordingly, the look-up table 175 read out the overshoot compensated R, G, and B data or the modulated R, G, and B data in a storing region corresponding to the modulated data of the current frame and the delayed R, G, and B data of the previous frame. The read-out R, G, and B data are applied to the data driver 130 as the overshoot compensated R, G, and G data.

The ODC 170 described above can overshoot-compensate the modulated R, G, and B data, which are output from the gray scale modulator 160, in every gray scale level. The overshoot-compensated R, G, and B data generated in the ODC 170 are applied to every pixel on the LCD panel 110 through data driver 130.

Herein, if the overshoot-compensated R, G, and B data are 8 bit data, their maximum values may correspond to 255 gray scale level. Alternatively, in case the overshoot-compensated R, G, and B data are a 10 bit data, their maximum values may become a 1032 gray scale level. In accordance therewith, the gray scale modulator 160 should output the modulated R, G, and B data each having the maximum value that is lower than those of the overshoot-compensated R, G, and B data. For example, the maximum value of the modulated R, G, and B data may become 240 or 990 gray scale level, which is lower than 250 or 1032 gray scale level.

In this manner, the LCD device, according to the embodiment of the present disclosure, includes the gray scale modulator 160 modulating the R, G, and B data of every gray scale level which will be applied to the ODC 170, making possible the overshoot-compensation for every gray scale level. Therefore, the LCD device according to the embodiment of the present disclosure can be driven in the high speed for the maximum gray scale level of the R, G, and B data, and furthermore can improve the quality of every picture.

As described above, the LCD device, according to an embodiment of the present disclosure, modulates the received R, G, and B data by means of the gray scale modulator, in a state of dimming the backlight. Therefore, the LCD device can prevent the blurring phenomenon and can compensate for the brightness deterioration caused by the dimming of the backlight. Moreover, the LCD device, according to an embodiment of the present disclosure, is over-driven for every gray scale level of the modulated R, G, and B data (for example, 8 bit data) which includes the maximum gray scale level (for example, 255 gray scale level). The LCD device also can further improve its motion picture response time (MPRT). As a result, the LCD device, according to the embodiment of the present disclosure, may improve the picture quality.

It will be apparent to those skilled in the art that various modifications and variations can be made in the present disclosure. Thus, it is intended that the present disclosure cover the modifications and variations of this embodiment provided they come within the scope of the appended claims and their equivalents.

What is claimed is:

1. A liquid crystal display device comprising:

a timing controller generating control signals for an image display;

a gray scale modulator modulating R, G, and B data from the timing controller;

a backlight dimming controller generating a back dimming signal that is inversely proportional to the modulated R, G, and B data generated in the gray scale modulator; and an over driving controller selectively overshoot-compensating the modulated R, G, and B data of a current frame based on a comparison of the modulated R, G, and B data of the current frame and the modulated R, G, and B data of a previous frame, wherein a range of gray scale levels of the modulated R, G, and B data is greater than that of the R, G, and B data received from the timing controller, but smaller than that of the overshoot-compensated R, G, and B data.

2. A liquid crystal display device comprising:

a timing controller generating control signals for an image display;

a gray scale modulator modulating R, G, and B data from the timing controller;

a backlight dimming controller generating a back dimming signal that is inversely proportional to the modulated R, G, and B data generated in the gray scale modulator; and an over driving controller selectively overshoot-compensating the R, G, and B data from the gray scale modulator in every gray scale level through the comparison of the R, G, and B data of current frame and the R, G, and B data of previous frame, wherein the modulated R, G, and B data each include maximum gray scale levels lower than those of the overshoot compensated R, G, and B data, wherein the gray scale modulator modulates gray-scales of the R, G, and B data by a decrement amount of a duty cycle of the back dimming signal, wherein the over-driving controller comprises a frame memory delaying the modulated R, G, and B data from the gray scale modulator during one frame period and a look-up table comparing the delayed R, G, and B data from the frame memory with the modulated data from the gray scale modulator, and selectively outputting the overshoot compensated R, G, and B data and the modulated R, G, and B data of the current frame in accordance with the comparing resultant, wherein the modulated R, G, and B data each include maximum gray scale levels upper than those of the R, G, and B data from the timing controller, wherein the look-up table uses the modulated R, G, and B data of the current frame and the modulated R, G, and B data of the previous frame as an x-axis address and an y-axis address, respectively and the look-up table stores the overshoot compensated R, G, and B data and the modulated R, G, and B data which are arranged in accordance with the x-axis and y-axis addresses, wherein the over-driving controller derives the overshoot compensated R, G, and B data from the modulated R, G, and B data and applies the overshoot compensated R, G, and B data to the data driver, and wherein the modulated R, G, and B data has the range of "0" to "244" gray scale levels and the over-driven data also may become in the range of "0" to "255" gray scale levels.

3. The liquid crystal display device as claimed in claim 2, wherein the over-driving controller does not conduct overshoot compensation when the R, G, and B data of the current frame applied from the gray scale modulator is the same as those of the previous frame, and the over-driving controller derives the overshoot compensated R, G, and B data from the modulated R, G, and B data when the R, G, and B data of the current frame applied from the gray scale modulator is different from those of the previous frame.

4. The liquid crystal display device as claimed in claim 2, wherein the over-driving controller outputs modulated R, G, and B data to a data driver when the R, G, and B data of the current frame applied from the gray scale modulator is the same as those of the previous frame.

5. The liquid crystal display device claimed as claim 2, wherein the look-up table read out the overshoot compensated R, G, and B data or the modulated R, G, and B data in a storing region corresponding to the modulated data of the current frame and the delayed R, G, and B data of the previous frame and the read-out R, G, and B data are applied to the data driver as the overshoot compensated R, G, and G data.

6. A method of driving a liquid crystal display device, comprising:

modulating R, G, and B data from the exterior in the gray scale;

selectively overshoot-compensating the R, G, and B data from the gray scale modulator in every gray scale level through the comparison of the R, G, and B data of current frame and the R, G, and B data of previous frame; and applying lights to a liquid crystal display panel, which receives the overshoot-compensated R, G, and B data, by means of a backlight unit of dimming system, wherein the modulated R, G, and B data have maximum gray scale levels lower than those of the overshoot-compensated R, G, and B data, wherein the gray scale modulator modulates gray-scales of the R, G, and B data by a decrement amount of a duty cycle of the back dimming signal, wherein the over-driving controller comprises a frame memory delaying the modulated R, G, and B data from the gray scale modulator during one frame period and a look-up table comparing the delayed R, G, and B data from the frame memory with the modulated data from the gray scale modulator, and selectively outputting the overshoot compensated R, G, and B data and the modulated R, G, and B data of the current frame in accordance with the comparing resultant, wherein the modulated R, G, and B data each include maximum gray scale levels upper than those of the R, G, and B data from a timing controller, wherein the look-up table uses the modulated R, G, and B data of the current frame and the modulated R, G, and B data of the previous frame as an x-axis address and an y-axis address, respectively and the look-up table stores the overshoot compensated R, G, and B data and the modulated R, G, and B data which are arranged in accordance with the x-axis and y-axis addresses, wherein the over-driving controller derives the overshoot compensated R, G, and B data from the modulated R, G, and B data and applies the overshoot compensated R, G, and B data to the data driver, and wherein the modulated R, G, and B data has the range of "0" to "244" gray scale levels and the over-driven data also may become in the range of "0" to "255" gray scale levels.

7. The method of driving a liquid crystal display device as claimed in claim 6, wherein selectively overshoot-compensating the R, G, and B data from a gray scale modulator includes: not conducting overshoot compensation when the R, G, and B data of the current frame applied from the gray scale modulator is the same as those of the previous frame, and deriving the overshoot compensated R, G, and B data from the modulated R, G, and B data when the R, G, and B data of the current frame applied from the gray scale modulator is different from those of the previous frame.

8. The method of driving a liquid crystal display device as claimed in claim 6, further comprises outputting modulated R, G, and B data to a data driver when the R, G, and B data of the current frame applied from the gray scale modulator is the same as those of the previous frame.

9. The method claimed as claim 6, wherein the look-up table read out the overshoot compensated R, G, and B data or the modulated R, G, and B data in a storing region corresponding to the modulated data of the current frame and the delayed R, G, and B data of the previous frame and the read-out R, G, and B data are applied to the data driver as the overshoot compensated R, G, and G data.

* * * * *